US009504893B2

(12) United States Patent
Nelson

(10) Patent No.: US 9,504,893 B2
(45) Date of Patent: Nov. 29, 2016

(54) BODY HARDENING MACHINE THAT SIMULATES MARTIAL ARTS SPARRING

(71) Applicant: Jonathan Cameron Nelson, Brooklyn, NY (US)

(72) Inventor: Jonathan Cameron Nelson, Brooklyn, NY (US)

( * ) Notice: Subject to any disclaimer, the term of this patent is extended or adjusted under 35 U.S.C. 154(b) by 0 days.

(21) Appl. No.: 14/462,592

(22) Filed: Aug. 19, 2014

(65) Prior Publication Data

US 2015/0011365 A1 Jan. 8, 2015

Related U.S. Application Data

(63) Continuation-in-part of application No. 13/797,672, filed on Mar. 12, 2013, now abandoned.

(51) Int. Cl.

| | |
|---|---|
| ***A63B 69/22*** | (2006.01) |
| ***A63B 69/00*** | (2006.01) |
| ***A63B 69/20*** | (2006.01) |
| ***A63B 69/34*** | (2006.01) |
| ***A63B 71/06*** | (2006.01) |
| *A63B 71/02* | (2006.01) |

(52) U.S. Cl.

CPC ..... *A63B 69/004* (2013.01); *A63B 69/20* (2013.01); *A63B 69/205* (2013.01); *A63B 69/34* (2013.01); *A63B 71/0622* (2013.01); *A63B 71/023* (2013.01); *A63B 2071/026* (2013.01); *A63B 2207/02* (2013.01); *A63B 2210/50* (2013.01); *A63B 2225/09* (2013.01)

(58) Field of Classification Search

CPC ..... A63B 23/0405; A63B 23/0482; A63B 23/0494; A63B 23/12; A63B 23/1209; A63B 23/1245; A63B 23/1281; A63B 69/004; A63B 69/20; A63B 69/201; A63B 69/203; A63B 69/205; A63B 69/206; A63B 69/208; A63B 69/24; A63B 69/26; A63B 69/32; A63B 69/325; A63B 69/34; A63B 69/345; A63B 2069/0042; A63B 2069/0044; A63B 71/023; A63B 71/04; A63B 2071/025; A63B 2071/026; A63B 2071/027; A63B 2208/0204; A63B 2208/0209; A63B 2210/50; A63B 2225/09; A63B 2225/093; A63B 2225/10; A63B 2244/10; A63B 2244/102; A63B 2244/104; A63B 2244/106; A63B 2244/108

See application file for complete search history.

(56) References Cited

U.S. PATENT DOCUMENTS

| | | | | | |
|---|---|---|---|---|---|
| 2,088,861 | A * | 8/1937 | Klum | A63B 69/345 | 114/219 |
| 2,547,124 | A * | 4/1951 | Hudson | A63B 69/205 | 248/341 |
| 4,749,184 | A * | 6/1988 | Tobin | A63B 69/0091 | 482/129 |
| 4,911,428 | A * | 3/1990 | Wiece | A63B 69/201 | 248/325 |
| 4,940,228 | A * | 7/1990 | Horvath | A63B 69/34 | 273/386 |
| 5,267,485 | A | 12/1993 | Chi | | |
| 5,352,170 | A * | 10/1994 | Condo | A63B 69/201 | 482/83 |
| 5,389,057 | A * | 2/1995 | Zagata, Jr. | A63B 69/20 | 482/83 |
| D356,127 | S * | 3/1995 | Mara | D21/798 | |

(Continued)

*Primary Examiner* — Stephen Crow
*Assistant Examiner* — Gary D Urbiel Goldner
(74) *Attorney, Agent, or Firm* — Benjamin Davis

(57) ABSTRACT

The present invention concerns a machine for martial arts training that simulates sparring with a live partner and provides a safe tool for body hardening. The machine is a vertical alignment of three independently rotatable alpha bodies having arms and a weighted base, where each alpha body rotates when met by force from a user. The machine facilitates martial arts offensive strikes and defensive moves, which safely promotes the formation of calcium deposits and scar tissue about key nerve areas to give the body a hardened feel.

10 Claims, 10 Drawing Sheets

(56) References Cited

U.S. PATENT DOCUMENTS 5,496,204 A * 3/1996 Brown ..... A63B 5/22 273/440
5,722,920 A * 3/1998 Bauer ..... A63B 69/004 482/83
5,725,193 A 3/1998 Adams
5,863,278 A 1/1999 Chen
5,899,835 A * 5/1999 Puranda ..... A63B 69/34 482/83
6,220,992 B1 4/2001 Shafik
6,254,115 B1 7/2001 Lin
6,398,697 B1 * 6/2002 Nichols, Jr. ..... A63B 69/20 473/441
7,329,210 B1 * 2/2008 Marano ..... A63B 69/004 482/83
7,416,517 B2 8/2008 Mitchell
7,513,853 B1 * 4/2009 Russ ..... A63B 22/0056 482/28
8,033,963 B1 * 10/2011 Jones ..... A63B 21/0628 482/100
8,602,944 B2 12/2013 Fleitz
2002/0013198 A1 * 1/2002 Mackay ..... A63B 69/004 482/79
2004/0176222 A1 * 9/2004 Mitchell ..... A63B 69/004 482/83
2004/0209743 A1 * 10/2004 Perez ..... A63B 69/34 482/83
2006/0025284 A1 2/2006 Livingstone
2007/0167297 A1 * 7/2007 Stevenson ..... A63B 69/004 482/83
2008/0119335 A1 * 5/2008 Luigi ..... A63B 69/20 482/89
2008/0220949 A1 9/2008 Yang
2008/0254950 A1 10/2008 Beliles
2010/0179031 A1 * 7/2010 Luigi ..... A63B 69/004 482/89
2011/0015040 A1 * 1/2011 Fleitz ..... A63B 69/004 482/8
2012/0040804 A1 * 2/2012 Detterberg ..... A63B 69/0053 482/83
2013/0059699 A1 * 3/2013 Brenner ..... A63B 69/004 482/83
2013/0231223 A1 * 9/2013 Scully ..... A63B 69/20 482/87
2014/0302969 A1 * 10/2014 Chen ..... A63B 69/203 482/90
2016/0023078 A1 * 1/2016 Haselrig ..... A63B 69/004 482/87

* cited by examiner

10

10

50

80

BODY HARDENING MACHINE THAT SIMULATES MARTIAL ARTS SPARRING

CROSS REFERENCE TO RELATED APPLICATIONS

This patent application is a continuation in part of patent application Ser. No. 13/797,672 filed on Mar. 12, 2013, which is now expressly abandoned.

FIELD OF THE INVENTION

The present invention concerns a machine for martial arts training that simulates sparring with a live partner and provides a safe tool for body hardening. More specifically, the machine is a vertical alignment of three independently rotatable alpha bodies having arms and a weighted base, where each alpha body rotates when met by force from a user or may rotate to initiate strikes via servomotors. The present invention facilitates martial arts offensive strikes and defensive moves, which safely promotes the formation of calcium deposits and scar tissue about key nerve areas to give the body a hardened feel.

BACKGROUND OF THE INVENTION

Martial artists train and stay in shape by fighting one another in sparring matches. Sparring with a live partner has many advantages. It increases the possibility to develop fighting sequences and new modes of performance, enhances timing and balance techniques, decreases the risk of injury, presents an opportunity to practice throwing and falling skills, helps to develop strike and defense timing, simulates strikes and kicks with real-fight power and speed, raises sensitivity to opponents, and increases one's endurance and tolerance for pain.

Many martial artists seek to harden the body to increase their tolerance to pain through dangerous alternatives to sparring events. It is desirable to harden body areas like the shins, calves, inner and/or outer thigh, ribs, stomach, arms, hands, shoulders, kidneys, or back. They strike hard objects to "deaden" certain never and pain receptors in the body. Minor injuries from the strikes create micro fractures in bone and damage tissue near nerves giving the body a harden feel when calcification and scar tissue form during micro fracture healing. However, not properly executed, these techniques can cause serious injuries to anyone.

U.S. Pat. No. 6,220,992 to A. M. Shafik discloses a boxing exercise machine.

U.S. Pat. No. 5,863,278 to James Chen et al. discloses a boxing drill machine.

U.S. Pat. No. 5,267,485 to Donald W. Mitchelle discloses an interactive martial arts training machine.

U.S. Patent Pub. No. 2006/0025284 to J. F. Livingstone et al. concerns a portable exercise device having a base, which holds a pole in a vertical position having two arms.

U.S. Pat. No. 5,941,801 to L. D'Alto concerns a multi-directional combination boxing and kicking bag.

U.S. Pat. No. 6,872,171 to D. Haselrig concerns a martial arts training bag.

None of the above disclosures show a machine that uses a vertical alignment of alpha bodies with arms that strike key nerve areas to facilitate body hardening in a safe manner while simulating the advantages of sparring with a live partner. To that end, there is a need for the present invention.

SUMMARY OF THE INVENTION

The primary object of the present invention provides for a body hardening machine that simulates martial arts sparring with at least two Alpha Bodies that are vertically aligned and secured at an interface. The interface includes an upper press fit bearing cup and a lower press fit bearing cup, where the upper press fit bearing cup has a race for accepting an upper retaining ring with bearings, and the lower press fit bearing cup has a race for accepting a lower retaining ring with bearings. The press fit bearing cups each have holes for accepting threaded bolts about an outer surface thereof. The retaining rings with bearings each have a modified flange with holes for accepting the respective threaded bolts. A washer with a race at one surface thereof for accepting the upper retaining ring with bearings has a radially extending lip from another surface thereof for accepting the race of the lower press fit bearing cup, and the washer further having a threaded bore for accepting a central threaded bolt, which, when tightened, creates a compression socket for the interface, coupling the press fit bearing cups together. The invention further includes an upper half ring and a lower half ring, where the upper half ring is coupled to the outer surface of the upper press fit bearing cup, where the lower half ring is coupled to the outer surface of the lower press fit bearing cup, and where the half rings each have holes for accepting the respective threaded bolts.

An aspect of the present invention includes a body hardening machine that simulates martial arts sparring having at least two Alpha Bodies comprise an upper, a mid, and a lower Alpha Body that are vertically aligned and secured by interfaces at two locations. The first interface is between a bottom distal end of the upper Alpha Body and a top distal end of the mid Alpha Body, and a second interface between a bottom distal end of the mid Alpha Body and a top distal end of the lower Alpha Body.

An aspect of the present invention includes a body hardening machine that simulates martial arts sparring where the upper, the mid, and the lower Alpha Bodies are independently rotatable at the interface located between the bottom distal end of the upper Alpha Body and the top distal end of the mid Alpha Body, and the interface located between the bottom distal end of the mid Alpha Body and the top distal end of the lower Alpha Body.

An aspect of the present invention includes a body hardening machine that simulates martial arts sparring where a bottom distal end of the lower Alpha Body is friction fit with a bottom press fit bearing cup having a bottom retaining ring with bearings and is supported by a balanced base that includes a ring having a circular cross section, a cavity, and four legs equally spaced about its circumference thereof, where each leg pivots and radiates outwardly and downwardly terminating at a boss having holes sized and positioned to vertically accept a sleeve from a dumbbell like balance.

Yet another aspect of the present invention includes a body hardening machine that simulates martial arts sparring where each dumbbell like balance is a construct comprising a threaded shaft and the sleeve, bolts, and a bottom disc plate and an upper disc plate, where the bottom disc plate is weighted.

Still another aspect of the present invention includes a body hardening machine that simulates martial arts sparring where the sleeve of each dumbbell like balance is vertically passed through the hole located at the boss of each leg. The sleeve acts as an axial shaft for receiving a plurality of weights, where the plurality of weights are circular discs with axial holes slightly larger than a diameter for each sleeve, and where the weight is slipped over and onto each sleeve.

An aspect of the present invention includes a body hardening machine that simulates martial arts sparring where each Alpha Body includes a pair of detachable arms.

An aspect of the present invention includes a body hardening machine that simulates martial arts sparring where each detachable arm of the pair of detachable arms are strategically placed so that a user may strike or defend strikes from the machine at targeted nerve areas on their forearms, torso, and/or thighs including a radial nerve (top of the forearm), a ulnar nerve (underside of the forearm), a peroneal nerve (outside of thigh), a femoral nerve (inside of the thigh), and the abdomen (mid torso), where such strikes to or from the user to the pair of detachable arms safely promotes the formation of calcium deposits and scar tissue about these nerve areas to give the body of the user a hardened feel.

Another aspect of the present invention includes a body hardening machine that simulates martial arts sparring where a top of the upper Alpha Body is covered by a lid that is connected to a null up bar and boxing speed bag.

Another aspect of the present invention includes a body hardening machine that simulates martial arts sparring where six points of rotation are created that includes a top retaining ring with bearings located between a lid and the upper Alpha Body, an interface located between the upper and mid Alpha Bodies, another interface located between the mid and lower Alpha Bodies, and a bottom retaining ring with bearing located between the lower Alpha Body and a base.

Other objects, advantages, and novel features of the invention will become more apparent from the following detailed description when taken in conjunction with the accompanying drawings.

BRIEF DESCRIPTION OF THE DRAWINGS

The figures discussed below are non-limiting examples of the present invention and are not meant to serve as a limitation thereof.

DETAILED DESCRIPTION OF THE INVENTION

Definitions

Figure 1A:
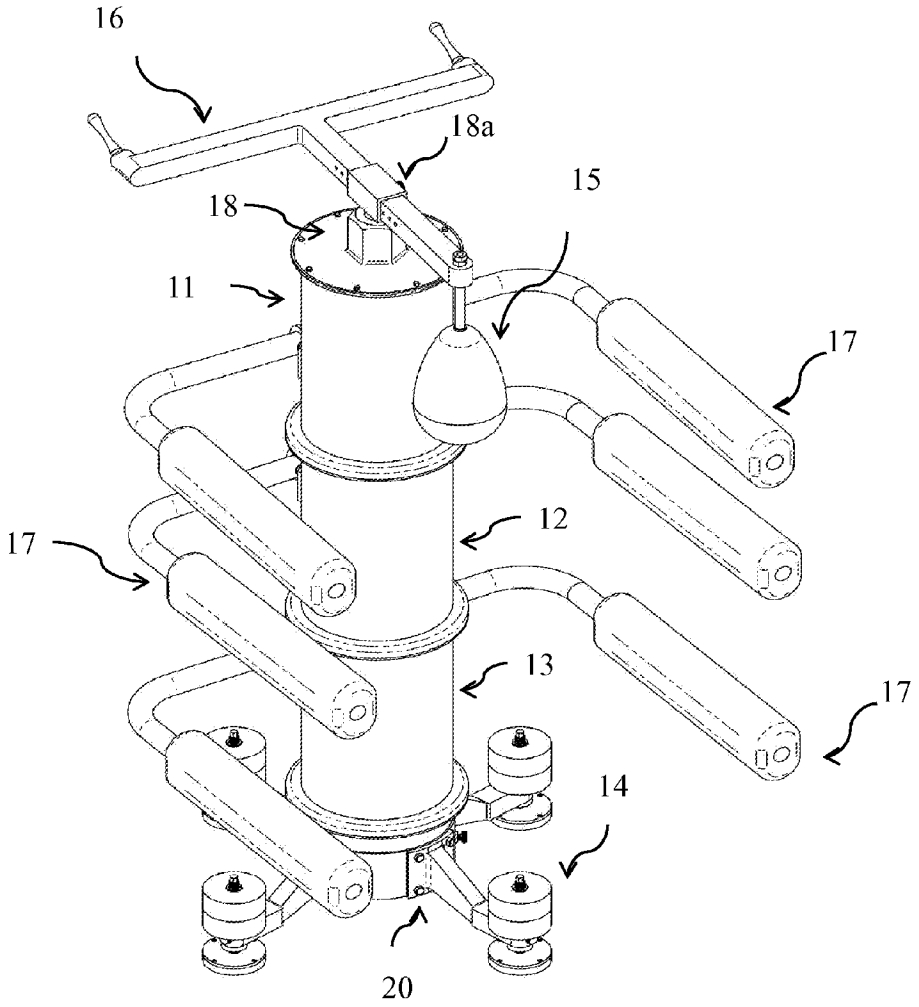
FIG. 1*a* is a front view of the present invention showing the machine 10 having three rotatable alpha bodies 11, 12, and 13 vertically aligned with padded arms 17 that are detachable and vertically moveable about the back area of each alpha body, a balanced base 20, a pull up bar 16, and an overhanging speed bag 15.

To detail the present invention, the following non-limiting terms are used:

The term "alpha body" generally refers to one rotatable cylindrical shell having detachable arms, retaining rings with bearings, press fit bearing cups with bearing races, a balanced base, half rings and bolts, flanged washer, and compression sockets, wherein the cylindrical shell may include a piece of cut sheet metal that has been rolled into a hemispherical shape where the edges are fastened or welded smooth to form a cylinder.

The term "machine" generally refers to a body hardening device that simulates sparring in the martial arts that includes a vertical alignment of three independently rotating alpha bodies with six points of rotation all supported by a balanced base. Each alpha body is a cylindrical shell having press fit bearing cups at their distal ends, a pair of detachable arms, upper and lower bearing assemblies, and a pull up bar and boxing speed bag located at the top of the upper alpha body.

The terms "base" or "balanced base" generally refer to a circular base having four equally spaced legs around its circumference that pivot a radiate downward and outward towards a floor and have four balances with shafts capable of supporting disc shaped weights.

The term "bearing assembly" generally refers to either a flanged retaining ring with bearings that roll along a race located in a press fit bearing cup on either distal end of an alpha body or an interface where two alpha bodies meet on the vertical alignment of alpha bodies where two points of rotation are formed.

The term "point of rotation" generally refers to a point along the vertically aligned alpha bodies that can freely rotate either by a bearing assembly or by a friction fit, typically being the point at a press fit cup at either distal end of all alpha bodies when vertically stacked.

The term "balance" generally refers to a dumbbell like construct that includes a threaded shaft and sleeve, bolts, and a bottom and upper disc plate. The bottom disc plate is weighted to give the machine a more secure balance.

The terms "vertical alignment" "vertically aligned" or "vertically stacked" generally refer to a vertical column formed when the upper, mid, and lower alpha bodies are stacked on each other forming at least one interface having a bearing assembly. A total of six points of rotation are created that includes a top retaining ring with bearings located between a lid and the upper Alpha Body, an interface located between the upper and mid Alpha Bodies, another interface located between the mid and lower Alpha Bodies, and a bottom retaining ring with bearing located between the lower Alpha Body and a base.

General Embodiment of the Invention

The Body Hardening Machine

From this point forward, the following words will describe the present invention. However, these words are not a limitation on the scope of the present invention, but are shared to illustrate certain embodiments thereof. The present invention facilitates martial arts offensive strikes and defensive moves, which safely hardens the body through the healing of micro fractures and the forming of scar tissue about key nerve areas.

From FIG. 1*a*, the machine 10 includes a vertical alignment of an upper 11, mid 12, and lower 13 alpha body, where each are independently rotatable from the other using a series of retaining rings with bearings, press fit bearing cups with races, flanged washers, compressions sockets, and connecting bolts. The lower alpha 13 body is associated with a base 20 having four balances 14. Each alpha body 11, 12, and 13 is a cylindrical shell having two arms 17 that are bolted with a bracket into holes in the back portion of the same and may rotate from zero degrees (0°) up to about ninety degrees (90°) in either direction normal to their vertical alignment.

However, it is a preferred embodiment of the present invention where rotation is from about zero degrees (0°) up to about forty five degrees (45°) in either direction normal to their vertical alignment. Strikes to or from the machine 10 is designed to target and calcify bone tissue near nerve areas on the user's forearms, torso, or thighs. The present invention includes a speed bag 15 and pull-up bar 16 to provide options for a more complete workout.

Figure 1B:
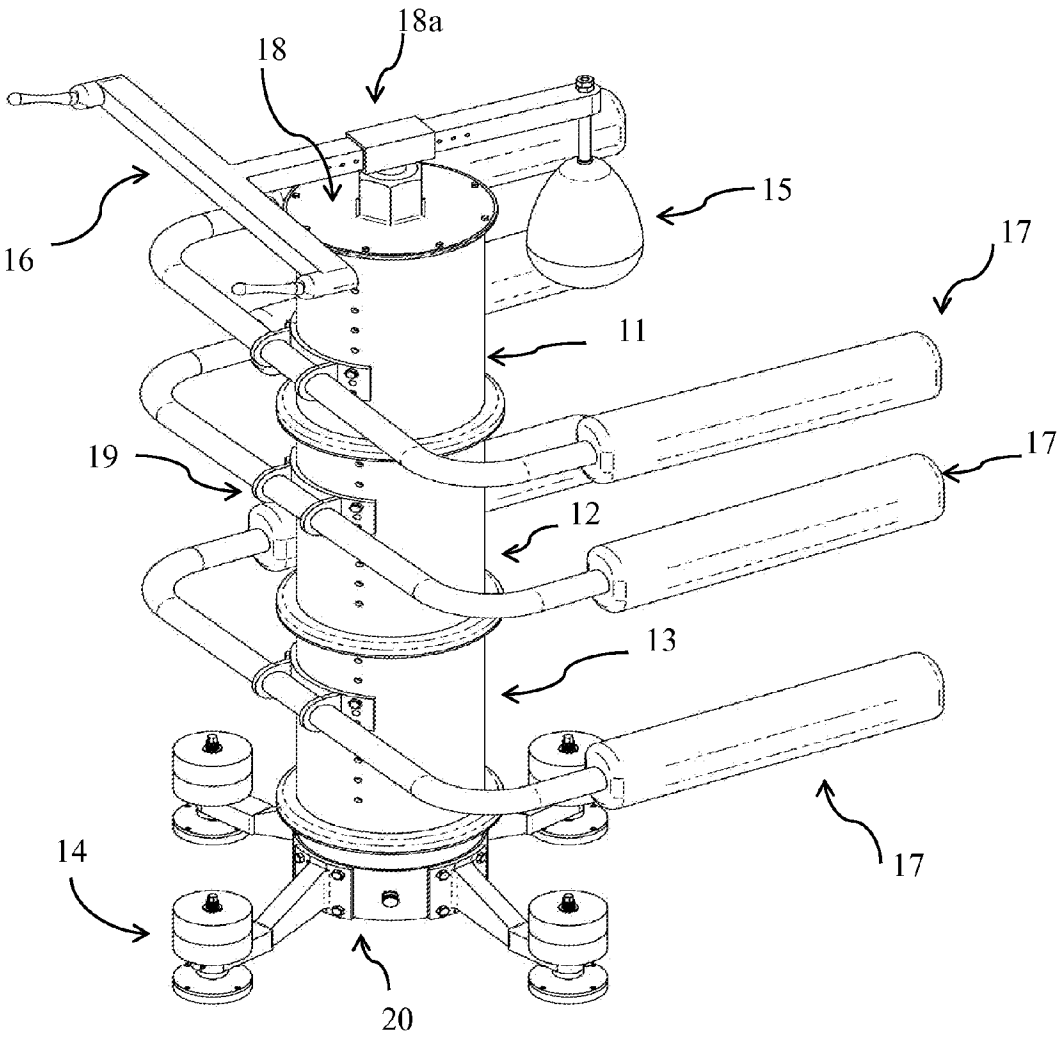
FIG. 1*b* is a rear view of the present invention showing the machine 10 having three rotatable alpha bodies 11, 12, and 13, vertically aligned with padded arms 17 that are detachable and vertically moveable about the back area of each alpha body, a weighted base 20, a pull up bar 16, and an overhanging speed bag 15.

From behind, FIG. 1*b*, each alpha body 11, 12, and 13 has a pair of detachable striking arms 17 that connect to and extend outward from their back area to face the user. The arms 17 are symmetrical U shaped tubes having pads about their outer limbs. Each pair of arms 17 is connected to the back portion of each alpha body 11, 12, and 13 with a bolted bracket 19 into holes about the same and may be detached when needed.

It is an embodiment of the present invention wherein the ends of each arm 17 may be easily fitted with a pair of boxing or kicking pads, giving the user the feel of a simulated striking practice for targeted jabs and kicks. Although not shown, these striking pads can be jointly connected to the ends of the arms to give each boxing or kicking pad a point of articulation and simulates the movement of a human wrist when struck. The boxing or kicking pads may have lighting elements, non-limiting examples being diodes, fiber optics, and the like, connected to an electric timing circuit that gives lighted sequences about the boxing or kicking pads for the user to follow. It is an embodiment of the present invention wherein the arms 17 may also have a wishbone type shape or an extended curve like shape to give the machine 10 a more stream lined look.

Each pair of arms 17 is parallel to the vertical plane of alignment created by the stacked alpha bodies 11, 12, and 13. When in use, the machine's 10 upper arms 17 are typically from about shoulder level to about face level but can also be located to strike one's upper torso at or below one's shoulders to about one's elbows. The mid alpha body's 12 arms 17 are situated near or at one's mid torso to about one's waist area, and arms 17 for the lower alpha body 13 are situated from about mid thigh level to about knee level. To reiterate, holes are provided at the back portion of each alpha body 11, 12, and 13 to adjust the vertical height of the arms 17 or to totally detach them.

The machine's 10 arms 17 are strategically placed such that a user may strike or defend strikes from the machine 10 at targeted nerve areas on their forearms, torso, and/or thighs. These nerve points may be repeatedly struck by alpha body arms 17, where strikes around key nerve areas harden tissue. These nerve areas include without limitation: the radial nerve (top of the forearm), the ulnar nerve (underside of the forearm), the peroneal nerve (outside of thigh), the femoral nerve (inside of the thigh), and the abdomen (mid torso).

An alpha body's 11, 12, and 13 rotation is propelled by force from a user's strike to any of the arms 17. The harder one hits the arms 17 the faster the alpha bodies 11, 12, and 13 will rotate. This momentum causes any of the arms 17 to come into a striking range for one to interact with the machine 10 to either block or strike the same. Alternatively, rotating the alpha bodies 11, 12, and 13 can also be achieved by a servomotor or series of servomotors to facilitate defensive moves, where key nerve areas are struck by the machine 10.

Alpha Body Construction and Rotation

Figure 2:
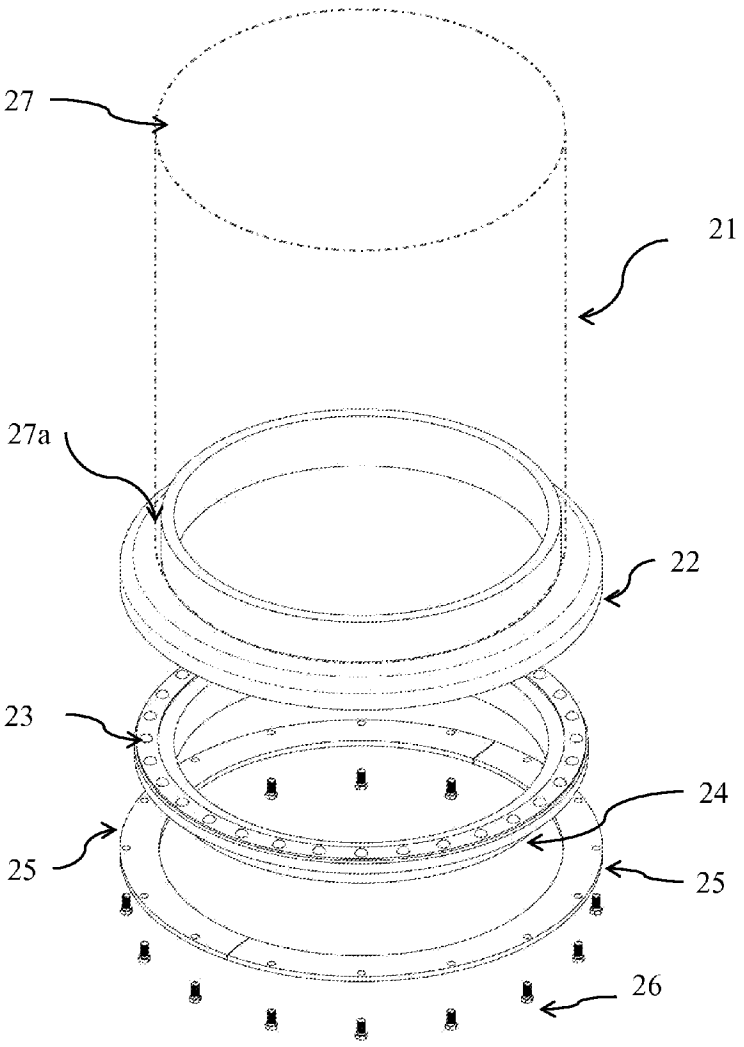
FIG. 2 depicts a typical bearing assembly located at the lower distal end of a cylindrical shell. The assembly includes a press fit bearing cup 22, a retaining ring with ball bearings 23, 24, and two half rings 25 with bolts 26 used to restrict vertical movement. This assembly may be repeated at the cylindrical shell's top distal end creating two points of rotation for an alpha body based solely on bearings.

FIG. 2 shows the basic design for each alpha body, which includes a cylindrical shell 21, a press fit bearing cup 22, a flanged retaining ring with bearings 23, 24, two half rings 25 and bolts 26. For simplicity, only the bottom assembly is shown, but it is an embodiment of the present invention wherein this design is repeated and used at the top distal end 27 of each cylindrical shell, depicted here by a dash dotted cylinder. Although each alpha body rotates independently from the other, they all share this design. However, when none of the alpha bodies have any bearings at their top distal ends, rotation is facilitated by friction.

An alpha body is a construct that includes a cylindrical shell 21 with two distal ends 27, 27*a*. Each end is friction fitted with a press fit bearing cup 22, being a cup like flange with one end having a built in race for the bearings 23 to roll along and the other end having a lip that vertically extends and friction fits into the inner surface of the cylindrical shell 21.

A flanged retaining ring 24 holds a set of ball or roller bearings 23 that fit neatly into the race of the press fit bearing cup 22, where the bearings 23, without limitation, may be about 0.25 inches in diameter to about 1.0 inches in diameter. To restrict vertical movement when the arms or a body of the machine are struck, the lower lip or surface of the flanged retaining ring 24 has holes to receive securing bolts 26 that pass through two half rings 25 located about the outer surface of the press fit bearing cup 22 and into the holes of the flanged retaining ring 24. This vertically stabilizes the machine and ensures a smooth rotation when met by force from the user.

The machine has six points of rotation, where there is one point of rotation located at the top and bottom of each alpha body. Rotation can be facilitated by having a ball bearing assembly at each rotation point or by having a ball bearing at the bottom of each alpha body an allowing friction rotation at the top for each of the same. Each bearing assembly is located at an interface between the distal ends of vertically aligned Alpha Bodies and includes an upper press fit bearing cup and a lower press fit bearing cup. The upper press fit bearing cup has a race for accepting an upper retaining ring with bearings, and the lower press fit bearing cup has a race for accepting a lower retaining ring with bearings. The press fit bearing cups each have holes for accepting threaded bolts about an outer surface thereof. The retaining rings with bearings each have a modified flange with holes for accepting the respective threaded bolts. A washer with a race at one surface thereof for accepting the upper retaining ring with bearings has a radially extending lip from another surface thereof for accepting the race of the lower press fit bearing cup, and the washer further having a threaded bore for accepting a central threaded bolt, which, when tightened, creates a compression socket for the interface, coupling the press fit bearing cups together. The invention further includes an upper half ring and a lower half ring, where the upper half ring is coupled to the outer surface of the upper press fit bearing cup, where the lower half ring is coupled to the outer surface of the lower press fit bearing cup, and where the half rings each have holes for accepting the respective threaded bolts. Although having a two bearing assemblies will allow for smoother rotations when an alpha body is struck by force, for simplicity in FIG. 2, only the lower ball bearing assembly is shown and the top portion of the cylindrical shell will rotate via friction. It is a preferred embodiment of the invention wherein a top assembly is constructed identical to the lower assembly shown and is also vertically stabilized by two half rings 25 located about the top outer portion of the press fit bearing cup 22 by bolts 26 secured into a flanged retaining ring 24 (see FIG. 4).

Figure 4:
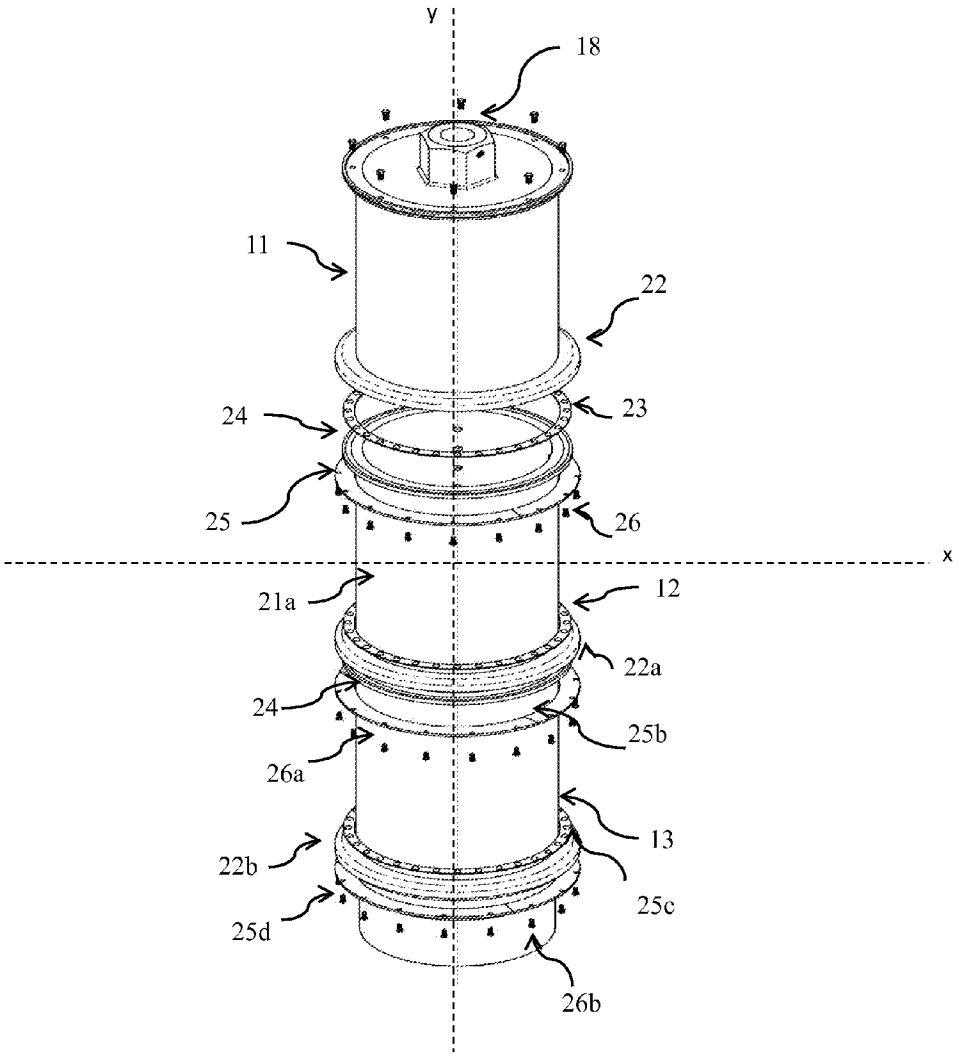
FIG. 4 is an exploded view of vertical aligned upper 21, mid 21*a*, and lower 21*b* alpha bodies. A simple x-y axis shows the center point of the machine and the various points of rotation.

FIG. 4 is an exploded view that emphasizes how the upper, mid, and lower alpha bodies are assembled and stacked. The machine has three alpha bodies 21, 21*a*, and 21*b*, each having press fit bearing cups 22, 22*a*, 22*b*, that rest on a flanged retaining ring with bearings 23 and 24, half rings 25, 25*a*, 25*b*, 25*c*, and 25*d*, bolts 26 and 26*a*, and a top lid 18 to cover the upper alpha body cavity and to support the pull up bar and speed bag. For clarity, the arms for each alpha body 21, 21*a*, and 21*b*, the pull up bar and speed bag, and the base are not shown but are still intended to be essential to the machine.

From FIG. 4, a vertical column is formed when the upper 21, mid 21*a*, and lower 21*b* alpha bodies are stacked on each other. A bearing assembly having a press fit bearing cup 22 with a race for bearings 23 to roll along, flanged retaining ring 24 with bearings 23, and two half rings 25, 25*a*, 25*b*, 25*c*, 25*d* and bolts 26, 26*a*, 26*b* are located between the upper alpha body's 11 bottom distal end and the mid alpha body's 12 top distal end. This bearing assembly is repeated at the mid alpha body's 12 bottom distal end and the lower alpha body's 13 top distal end. The lower alpha body 13 rests on a similar bearing assembly between its lower distal end and the top surface of the base (not shown). Another bearing assembly may be located between the upper alpha body's 11 top distal end and the top lid 18. The x-y graph shows the center point of the invention being the mid alpha body 12. Half rings 25, 25*a*, 25*b*, 25*c*, and 25*d*, secure the alpha bodies 11, 12, 13 to reduce any vertical movement when the machine is struck. This design ensures that the alpha bodies 11, 12, 13 can rotate in either direction from about 0° to about 90° when in use. In this embodiment the top distal ends for each alpha body 11, 12, 13 is devoid of a bearing assembly and rotates by friction.

Independent Rotation With a Two Bearing Assembly

Figure 3:
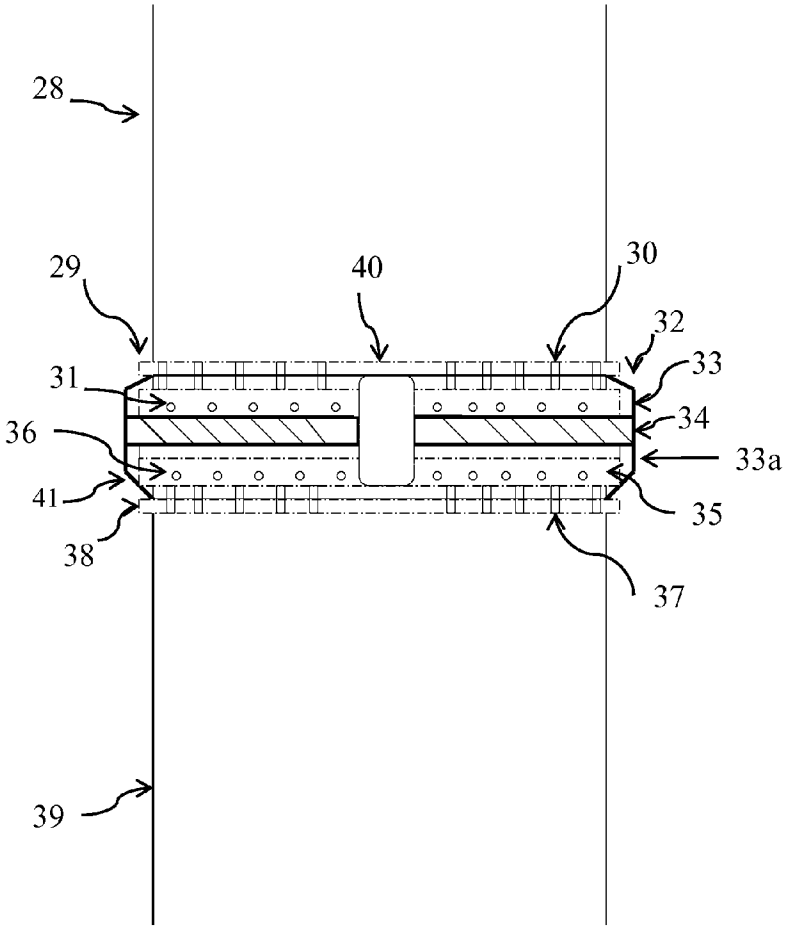
FIG. 3 depicts a two bearing assembly resulting in two points of rotation for the invention. The two bearing assembly is a relationship between upper 31 and lower 36 bearings located at the lower distal end 32 of the upper alpha body and the top distal end 41 of the mid alpha body. The cross section includes upper 28 and mid 39 cylindrical shells, press fit bearing cups 33, 33*a*, half rings 29, 38, flanged retaining rings 32, 35 and bearings 31, 36, a compression socket 40, bolts 30, 37, and a flanged washer 34.

Independent rotation is realized by a relationship between two bearing assemblies, an example being two bearing assemblies located at the upper alpha body's lower distal end and the mid alpha body's top distal end, the cross section depicted in FIG. 3. A press fit bearing cup 33 is friction fitted at the bottom distal end 32 of the upper shell 28 and rests on a flanged retaining ring with bearings 31. The flanged retaining ring with bearings 31 is oriented so that the lip, which radially extends from one side of the retaining ring 31, is in contact with a race located in the upper portion of the pressed fit bearing cup 33. The bearing side of the retaining ring 31 rests in a race located in the surface of a flanged washer 34 and serves as a lower point of rotation for the upper alpha body.

The flanged washer's 34 other surface has a lip that radially extends down from the washer 34 and into the outer surface area of a race located within a press fit bearing cup 33*a* friction fitted at the top distal end 41 of the mid alpha body. These bearings 36 are free to rotate in this race and serve as a top point of rotation for the mid alpha body. A threaded hole located in the center of the washer 34 accepts a threaded bolt 40, which when tightened, creates a compression socket for the entire bearing assembly.

Half rings 29, 38 and bolts 30, 37 are used to secure the upper and mid alpha bodies at the bearing assembly. The outer surface for all press fit bearing cups 33, 33*a* and the lip side of the flanged retaining ring 24 have holes that receive securing bolts 30, 37, which pass through the press fit bearing cups 33, 33*a*, the two half rings 29, 38 located about the same, and into the holes located in the flanged retaining rings 31, 35. Bolting half rings 29, 38 to the flanged retaining ring with bearings 31 is repeated at the mid alpha body's top bearing assembly and prevents the machine from rocking or tilting when struck. It is an embodiment of the invention where the weight of the machine, due to the vertical stacking of the alpha bodies, the bearing assemblies, the half rings 29, 38 and bolts 30, 37, and the compression socket 40 for each bearing assembly creates a more stable machine that exhibits little rocking or tilting when struck.

The Base

Figure 5:
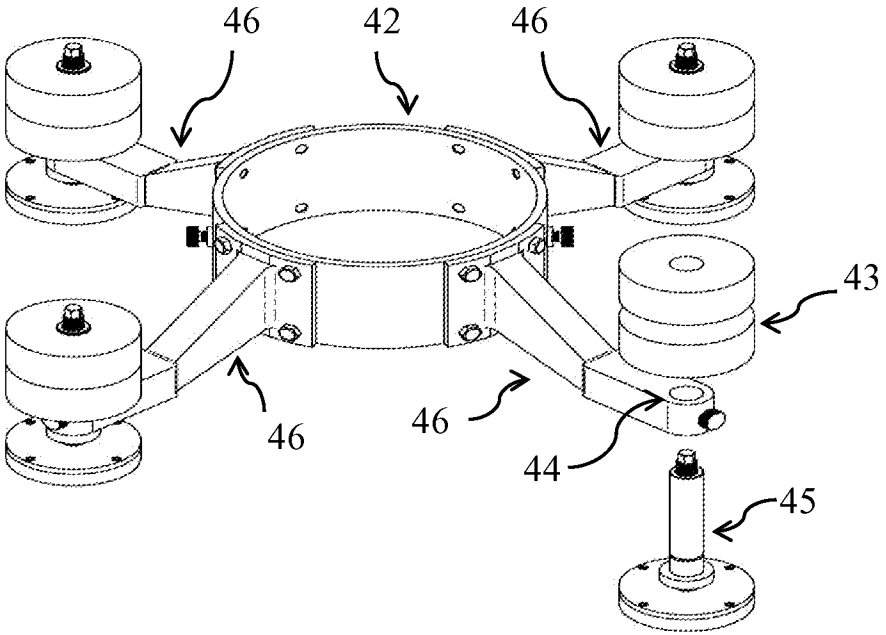
FIG. 5 depicts a balanced base having four legs 46 and balances 45 used to adjust the machine to an even height, where the base includes a ring with a circular cross section 42 having four equally spaced legs 47 around its circumference that pivot and radiate downward and outward towards a floor and has four balances 45 with shafts capable of supporting disc shaped weights 43.

It is an embodiment of the present invention wherein the machine is freestanding and is supported and balanced by a base. From FIG. 5, the base is a ring with a circular cross section 42 having four legs 46 equally spaced about its circumference, where the legs 46 pivot and radiate downward and outward towards a floor and has four dumbbell like balances 45 with shafts capable of supporting disc shaped weights 43. Each leg terminates at a horizontal boss 44, where each boss 44 has a circular opening sized to accept a vertical shaft from a balance 45. The base's open cavity is sized to friction fit with the lip side of a flanged retaining ring with bearings. This leaves the bearing side of the retaining ring free to roll along a race in the surface of the press fit bearing cup supporting the cylindrical shell of the lower alpha body. This configuration creates a base point of rotation for the lower alpha body.

Figure 6:
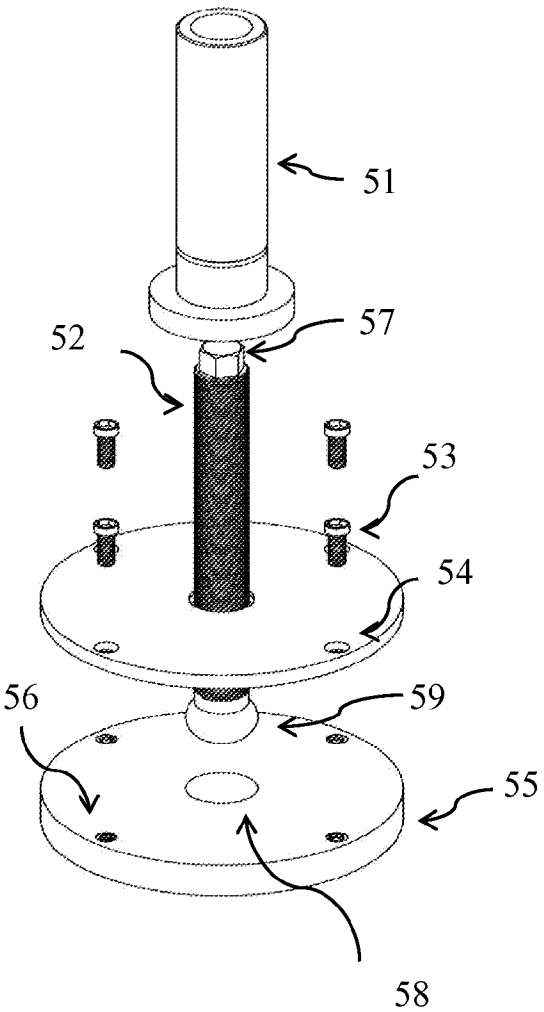
FIG. 6 is an exploded view of the dumbbell like balance used to support the machine. Each balance 50 is a dumbbell like construct that includes a threaded shaft 52 and sleeve 51, bolts 53, and a bottom 55 and upper disc plate 54.

From FIG. 6, the base includes a set of dumbbell like balances 50 for the four legs to rest. Each balance 50 is a dumbbell like construct that includes a threaded shaft 52 and sleeve 51, bolts 53, and a bottom 54 and upper disc plate 55. The threaded shaft 52 is basically a bolt with threads having a round foot 59 at one end and a hexagonal nut 57 tapered at the other. The nut end 57 of the threaded shaft 52 is passed through a center hole 58 of both securing plates 54, 55, such that the round foot 59 of each threaded shaft 52 sets flush against the bottom surface of the bottom plate 55. Each of the four feet serves as a balanced resting point for the machine against a horizontal floor. The threaded shaft 52 is secured by bolting a top securing plate 54 to the bottom securing plate 55. A sleeve 51 is then threaded onto the shaft 52. Once the balances 50 are assembled, each sleeve 51 is vertically passed through a hole located at the boss of each leg and acts as an axial shaft where a plurality of weights, having a circular disc configuration with an axial hole slightly larger than the shaft's diameter, may be slipped over and onto each sleeve 51.

Motor Assemblies

Figure 7:
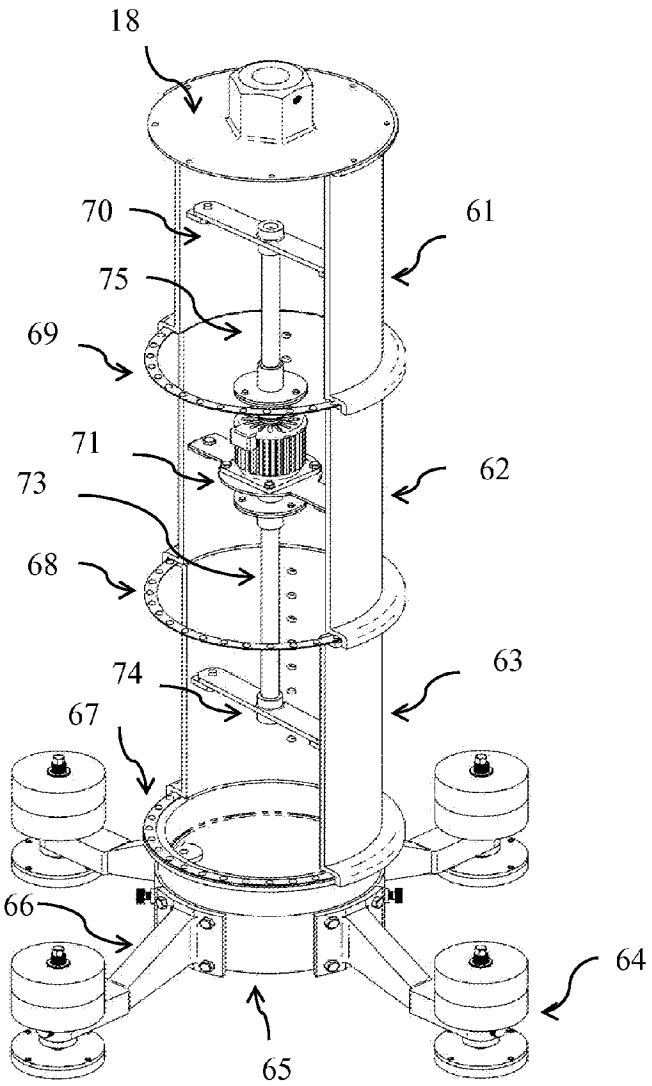
FIG. 7 is a cross section depicting a single motor embodiment of the present invention, wherein the motor 71 automates rotation for all alpha bodies 61, 62, 63 in concert, and the motor 71 is suspended at the center of the vertical column of stacked alpha bodies 61, 62, 63.

Although the machine may be propelled by force from a user's strike, it is an embodiment of the present invention wherein the alpha bodies are rotated by a motor system having an electric servomotor or series of electric servomotors and drive shafts capable of programmable martial arts sequences. FIG. 7 is a cross section view of the present invention, where alpha bodies 61, 62, and 63 are stacked to form a hollow column having six points of rotation, as previously described, with a one motor 71 system. The electric servomotor 71 is a standard type having a motor, a feedback device, an amplifier, and a motion controller, and a possible power transmission. The electric servomotor 71 can either by AC or DC in nature and may be brushed or brushless. The motor 71 can be single phase or three phase. For simplicity the arms are omitted but are intended to be a part of this embodiment. The motor assembly includes an electric servomotor 71 secured and suspended in the inner cavity of the mid alpha body 62. In this embodiment, the electric servomotor is connected to an upper 75 and lower 73 drive shaft, being tubular rods that pass through servo arms having holes at their centers to accept the same. Each servo arm is similar to a propeller with a hole in its center sized to accept the drive shaft and is bolted to flanges that protrude from the inner walls of an alpha body.

Through a motion controller (not shown), the electric servomotor 71 offers complex motion profiles and patterns for alpha body 61, 62, and 63 rotations. Because precision is high, the electric servomotor 71 gives precise control of torque, speed, and position of the alpha bodies 61, 62 and 63 and arms due to a closed loop feedback. An external controller ensures that both speed and torque are simultaneously controlled and reduces each alpha body's 61, 62, and 63 speed when approaching an end point of rotation and uses the appropriate force required to strike someone at key nerve areas to promote body hardening without causing injury.

A user control panel (not shown but standard in the art of motion control) may be a touch pad or a touch pad display and includes a programmable logic controller, for controlling voltages to the electric servomotor 71. The controller sends voltages to the servomotor 71 that allows the user to program motion sequences that rotates the alpha bodies 61, 62, and 63 to initiate striking patterns for a user to block. The user control panel may be provided with a display area for exhibiting the settings of selected patterns for rotation patterns for the alpha bodies 61, 62, and 63. It is preferred that the controller sends signals to the electric servomotor 71 to rotate each alpha body from about 0° to about 45° to 90° normal to the machine's vertical alignment.

Generally, a drive shaft consists of a long tubular rod having one end connected to a series of servo arms and the other end connected to the servomotor's shaft. The electric servomotor 71 transmits rotational motion to an upper drive shaft 75 that passes through the center of a servo arm 70 that is bolted to flanges that protrude from the inner walls of the upper alpha body 61 and to a lower drive shaft 73 that passes through the center of a lower servo arm 74, which is bolted to flanges that protrude from the inner walls of the lower alpha body 63. A mid servo arm is directly connected to the electric servomotor's 71 shaft and is bolted to flanges that protrude from the inner walls of the mid alpha body 62.

Figure 8:
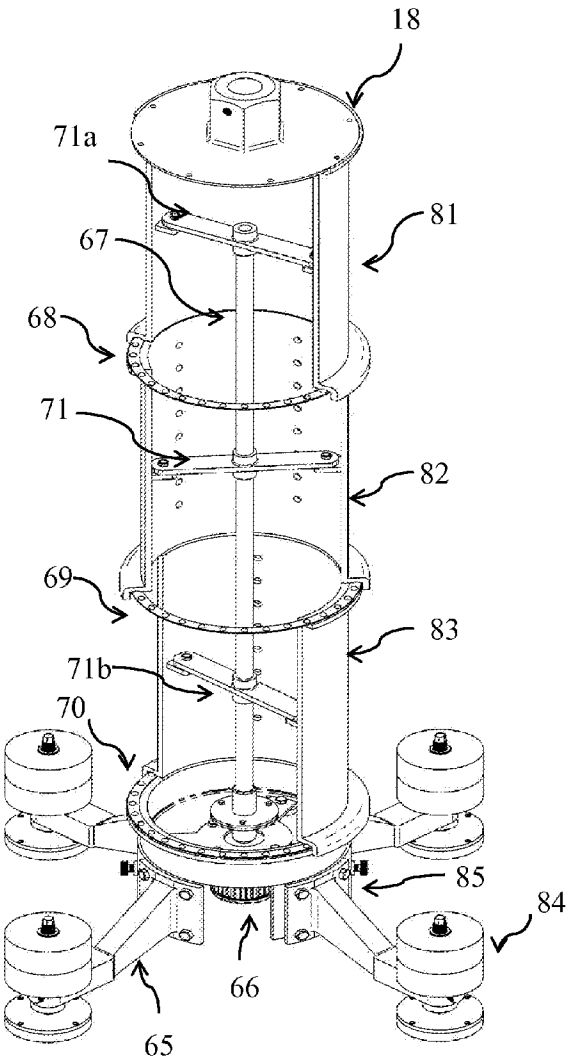
FIG. 8 is a cross section depicting a single motor embodiment of the present invention, wherein the motor 66 automates rotation of all alpha bodies 81, 82, 83 in concert. The motor 66 rests in a cavity at the center of the base 85.

FIG. 8 is another embodiment of the present invention. From the cross section view, three alpha bodies 81, 82, and 83 are stacked to form a hollow column having six points of rotation, as previously described, with a one motor system. For simplicity, the arms are omitted but are intended to be a part of this embodiment. The motor assembly includes an electric servomotor 66 secured and suspended in the inner cavity of the base 85. In this embodiment, the electric servomotor 66 is connected to a single drive shaft 67, being a tubular rod that passes through several servo arms 71, 71*a*, 71*b* having holes at their centers to accept the same. The motor 66 transmits rotational motion through a drive shaft to the center portion of the upper 81, mid 82, and lower alpha 83 bodies. Each servo arm is similar to a propeller with a hole in its center sized to accept the drive shaft and is bolted to flanges that protrude from the inner walls of each of the three alpha bodies 81, 82, and 83.

Figure 9:
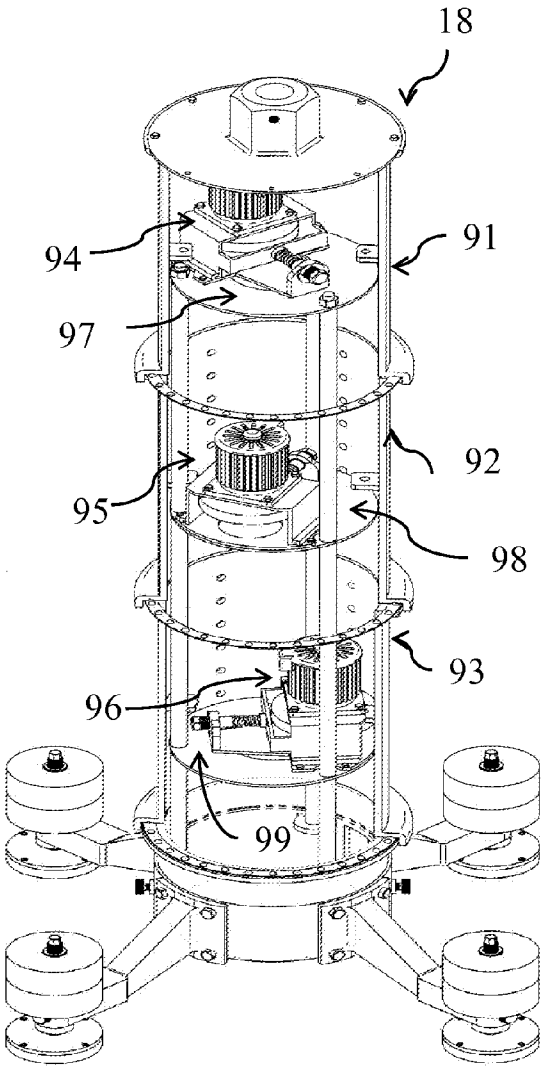
FIG. 9 is a cross section depicting a three motor embodiment of the present invention, wherein each servomotor 94, 95, 96 are connected by a rubber disc and flanges to the inner walls of the upper 91, mid 92, and lower 93 alpha bodies for independent rotation of each alpha body.

FIG. 9 is a three electric servomotor 94, 95, and 96 embodiment of the present invention. From the cross section view, three alpha bodies 91, 92, and 93 are stacked to form a hollow column having six points of independent rotation, as previously described, but with a three motor system. For simplicity, the arms are omitted but are intended to be a part of this embodiment. The upper 91, mid 92, and lower 93 alpha bodies each have their own electric servomotor to bring about independent rotation. Each servomotor 94, 95, and 96 rests on a rubber disc 97, 98, and 99 that has a diameter that allows the disc to set flush against the inner walls of an alpha body. The disc 97, 98, and 99 acts similar to a drive shaft. When each electric servomotor 94, 95, and 96 rotates their respective disc 97, 98, and 99 rotates and transfers this motion to the walls of each alpha body 91, 92, and 93, thereby rotating the alpha bodies 91, 92, and 93, according to the controlled programming for each servomotor 94, 95, and 96.

Machine Size

Referring to FIG. 2, the cylindrical shell 21, being a main construct of an alpha body, includes a piece of cut sheet metal that has been rolled into a hemispherical shape, where the edges are fastened or welded smooth to form a hollow tube that has a circumference from about 20" to about 44" and has a height from about 15" to about 34". It is an embodiment of the present invention wherein the upper alpha body has a slightly greater length than the mid and lower alpha bodies as to mimic the upper proportions of the human body relative to the lower torso and thigh and knee areas. Each cylindrical shell 21 is then friction fit with a press fit bearing cups 22 at both distal ends 27 and 27*a*. When the alpha bodies are vertical stacked, six points of rotation are created at interfaces having bearing assemblies including the lid and upper alpha body, the upper and mid alpha bodies, the mid and lower alpha bodies, and the lower alpha body and base.

From FIG. 1*b*, once the vertically aligned alpha bodies 11, 12, and 13 are secured with by half rings as described above, each alpha body 11, 12, and 13 may rotate to the right or to the left from about 0° to about 90° when struck by force or made to rotate by at least one electric servomotor. The height of the totally assembled machine 10 from the base, being horizontally flush to the floor to the apex of the pull up bar 16, is from about 5 feet to about 8 feet. The non-padded elements of the machine 10 may be made from metal, wood, hard plastics, or any combinations thereof. However, it is an embodiment of the invention wherein the non-padded elements of the machine 10 are made from a tempered steel alloy.

The arms 17 for each alpha body are detachable and are padded to protect the user from overly hard contact. The arms are positioned on each alpha body to strike and form hard tissue near key nerve points including but not limited to: the radial nerve (top of the forearm), the ulnar nerve (underside of the forearm), the peroneal nerve (outside of thigh), the femoral nerve (inside of the thigh), and the abdomen (mid torso).

The top distal end of the upper alpha body 11, 12, and 13 is fully covered by a circular lid 18 having an appropriate circumference and a hexagonal nut that extends from the lid's center that threadly accepts a locating member 18*a*. Two suspension arms are made to form a T-shaped bar that frictions fits into the locating member 18*a*. One portion of the T-shaped bar has left and right handles and acts as a pull up bar 16. The other end of the T-shaped bar passes through the locating member 18*a*. A speed bag 15 hangs from a shaft that passes through a hole located at the end of this portion of the T-shaped bar and is secured by a bolt.

What has been described above includes various exemplary aspects of a machine that facilitates martial arts training, which simulates sparring with a live partner and provides a safe tool for body hardening. It is, of course, not possible to describe every conceivable combination of components or methodologies for purposes of describing these aspects, but one of ordinary skill in the art may recognize that many further combinations are possible. The invention is not limited to any particular dimensions of the various elements, but the above are non-limiting examples of practical sizes. Accordingly, the aspects described herein are intended to embrace all such alterations, modifications and variations that fall within the spirit and scope of the following claims.

I claim:

1. A body hardening machine that simulates martial arts sparring comprising: at least two Alpha Bodies that are vertically aligned and secured at an interface that includes:

a) an upper press fit bearing cup and a lower press fit bearing cup, wherein the upper press fit bearing cup has a race for accepting an upper retaining ring with bearings, wherein the lower press fit bearing cup has a race for accepting a lower retaining ring with bearings, and wherein the press fit bearing cups each have holes for accepting threaded bolts about an outer surface thereof;

b) the retaining rings with bearings each having a modified flange with holes for accepting the respective threaded bolts;

c) a washer with a race at one surface thereof for accepting the upper retaining ring with bearings, the washer having a radially extending lip from another surface thereof for accepting the race of the lower press fit bearing cup, and the washer further having a threaded bore for accepting a central threaded bolt which, when tightened, creates a compression socket for the interface, coupling the press fit bearing cups together; and d) an upper half ring and a lower half ring, wherein the upper half ring is coupled to the outer surface of the upper press fit bearing cup, wherein the lower half ring is coupled to the outer surface of the lower press fit bearing cup, and wherein the half rings each have holes for accepting the respective threaded bolts.

2. The body hardening machine that simulates martial arts sparring of claim 1, wherein the at least two Alpha Bodies comprise an upper, a mid, and a lower Alpha Body that are vertically aligned and secured by interfaces at two locations, firstly between a bottom distal end of the upper Alpha Body and a top distal end of the mid Alpha Body, and a secondly between a bottom distal end of the mid Alpha Body and a top distal end of the lower Alpha Body.

3. The body hardening machine that simulates martial arts sparring of claim 2, wherein the upper, the mid, and the lower Alpha Bodies are independently rotatable at the interface located between the bottom distal end of the upper Alpha Body and the top distal end of the mid Alpha Body, and the interface located between the bottom distal end of the mid Alpha Body and the top distal end of the lower Alpha Body.

4. The body hardening machine that simulates martial arts sparring of claim 2, wherein a bottom distal end of the lower Alpha Body is friction fit with a bottom press fit bearing cup having a bottom retaining ring with bearings and is supported by a balanced base that includes a ring having a circular cross section, a cavity, and four legs equally spaced about a circumference thereof, wherein each leg pivots and radiates outwardly and downwardly terminating at a boss having a hole sized and positioned to vertically accept a sleeve from a dumbbell like balance.

5. The body hardening machine that simulates martial arts sparring of claim 4, wherein each dumbbell like balance is a construct comprising the threaded shaft and the sleeve, bolts, and a bottom disc plate and an upper disc plate, wherein the bottom disc plate is weighted.

6. The body hardening machine that simulates martial arts sparring of claim 5, wherein the sleeve of each dumbbell like balance is vertically passed through the hole located at the boss of each leg, the sleeve acting as an axial shaft for receiving a plurality of weights, the plurality of weights being circular discs with axial holes slightly larger than a diameter of each sleeve, wherein one or more weights of the plurality of weights are slipped over and onto each sleeve.

7. The body hardening machine that simulates martial arts sparring of claim 2, wherein a top of the upper Alpha Body is covered by a lid that is connected to a pull up bar and boxing speed bag.

8. The body hardening machine that simulates martial arts sparring of claim 2, wherein six points of rotation are created that includes a top retaining ring with bearings located between a lid and the upper Alpha Body, the interface located between the upper and mid Alpha Bodies, the interface located between the mid and lower Alpha Bodies, and a bottom retaining ring with bearings located between the lower Alpha Body and a base.

9. The body hardening machine that simulates martial arts sparring of claim 1, wherein each Alpha Body includes a pair of detachable arms.

10. The body hardening machine that simulates martial arts sparring of claim 9, wherein each detachable arm of the pair of detachable arms are strategically placed so that a user may strike or defend strikes from the machine at targeted nerve areas on their forearms, torso, and/or thighs including: a radial nerve (top of the forearm), an ulnar nerve (underside of the forearm), a peroneal nerve (outside of thigh), a femoral nerve (inside of the thigh), and the abdomen (mid torso), wherein such strikes to or from the user to the pair of detachable arms safely promotes the formation of calcium deposits and scar tissue about these nerve areas to give the body of the user a hardened feel.

* * * * *